US011440716B2

(12) United States Patent
Blin

(10) Patent No.: US 11,440,716 B2
(45) Date of Patent: Sep. 13, 2022

(54) CARTON AND CARTON BLANK

(71) Applicant: WestRock Packaging Systems, LLC, Atanta, GA (US)

(72) Inventor: Patrick Blin, Châteauroux (FR)

(73) Assignee: WESTROCK PACKAGING SYSTEMS, LLC, Atlanta, GA (US)

( * ) Notice: Subject to any disclaimer, the term of this patent is extended or adjusted under 35 U.S.C. 154(b) by 769 days.

(21) Appl. No.: 16/326,015

(22) PCT Filed: Aug. 17, 2017

(86) PCT No.: PCT/US2017/047381
§ 371 (c)(1),
(2) Date: Feb. 15, 2019

(87) PCT Pub. No.: WO2018/035344
PCT Pub. Date: Feb. 22, 2018

(65) Prior Publication Data

US 2021/0339928 A1 Nov. 4, 2021

Related U.S. Application Data

(60) Provisional application No. 62/376,687, filed on Aug. 18, 2016.

(51) Int. Cl.
*B65D 71/42* (2006.01)

(52) U.S. Cl.
CPC ..... *B65D 71/42* (2013.01); *B65D 2571/0066* (2013.01); *B65D 2571/00277* (2013.01)

(58) Field of Classification Search
CPC ..... B65D 71/00; B65D 71/12; B65D 71/42; B65D 2571/00277; B65D 2571/0066
USPC ..... 206/147, 153
See application file for complete search history.

(56) References Cited

U.S. PATENT DOCUMENTS

| | | | | |
|---|---|---|---|---|
| 5,201,412 | A * | 4/1993 | Schuster | B65D 71/44 206/153 |
| 5,355,999 | A | 10/1994 | Sutherland | |
| 5,443,153 | A * | 8/1995 | Sutherland | B65D 71/44 206/152 |
| 8,096,413 | B2 | 1/2012 | Coltri De Paula | |
| 8,387,784 | B2 | 3/2013 | Gonzalez et al. | |
| 8,443,968 | B2 | 5/2013 | De Paula | |
| 2005/0199513 | A1 | 9/2005 | Bakx | |
| 2009/0127147 | A1* | 5/2009 | Sutherland | B65D 71/42 206/429 |

(Continued)

FOREIGN PATENT DOCUMENTS

| | | | |
|---|---|---|---|
| EP | 0838408 | A1 | 4/1998 |
| EP | 2067713 | A1 | 6/2009 |
| JP | 5850605 | B2 | 2/2016 |

(Continued)

*Primary Examiner* — Bryon P Gehman
(74) *Attorney, Agent, or Firm* — Neil G. Cohen; Brian J. Goldberg

(57) ABSTRACT

A top-engaging carrier includes a top panel (18*a*) and a sloping shoulder panel (16*a*) hinged to the top panel by a first fold line (21*a*). The first fold line is interrupted by at least two curved cut lines (40*a*) such that by folding the shoulder panel about the first fold line, an article-engaging edge is defined by each of the at least two curved cut lines. The shoulder panel includes a stress-reducing second fold line (29*a*) extending alongside at least a part of the first fold line.

19 Claims, 11 Drawing Sheets

(56) References Cited

U.S. PATENT DOCUMENTS

2012/0080328 A1 4/2012 De Paula

FOREIGN PATENT DOCUMENTS

| | | | |
|---|---|---|---|
| WO | WO03/004377 | A1 | 1/2003 |
| WO | WO2009/023822 | A1 | 2/2009 |
| WO | WO2010/101852 | A1 | 9/2010 |
| WO | WO2014/179258 | | 11/2014 |

* cited by examiner

CARTON AND CARTON BLANK

BACKGROUND

The field of the invention relates to a carton for receiving, grouping and holding articles, and more particularly, but not exclusively to a carton that provides a top-gripping carrier for receiving and retaining a group of articles.

Cartons for engaging multiple articles are useful for enabling consumers to obtain and transport a desired quantity of individual articles such as soft drinks or other beverages or food stuffs.

It is well known to provide top gripping article carriers in which an aperture is formed in a panel of the carrier; wherein the tabs are struck from said aperture, the tabs being displaced out of the plane of said panel when an article is received in the aperture, and the tabs engage the article generally about a flange or lip of the article. Such a carrier is disclosed in U.S. Pat. No. 2,936,070 to Poupitch and in U.S. Pat. No. 5,188,225 to Jorbin. It can be difficult to remove the articles from such carriers without damaging the carton. A further example of a known carrier is shown in U.S. Pat. No. 5,355,999 to Sutherland, wherein a clip for cans is taught having a supplementary locking mechanism.

It is desirable for ecological and economic reasons to minimize the quantity of material required while at the same time providing a secure carrier for the articles, that can offer strength and rigidity without increase in the use of materials required and/or that can offer improved efficiency in the automated assembly of the carton by a packaging machine. A small increase in complexity in a carton construction, such as the supplementary lock in U.S. Pat. No. 5,355,999, can cause a considerable reduction in the total throughput of a packaging machine because of the time required to manipulate the carton to engage the lock.

SUMMARY

According to a first aspect of the invention, there is provided a top-engaging carrier including a top panel, and a sloping shoulder panel hinged to the top panel by a first fold line, wherein the first fold line is interrupted by at least two curved cut lines such that by folding the shoulder panel about the first fold line, an article-engaging edge is defined by each of the at least two curved cut lines. The shoulder panel includes a stress-reducing second fold line extending alongside at least a part of the first fold line.

Optionally, the stress-reducing second fold line is configured to facilitate the contouring of said shoulder panel to corresponding portions of a plurality of adjacent articles being engaged by the carrier.

Optionally, the article-engaging edge is configured to engage a flange of a can.

Optionally, the stress-reducing second fold line is curved with its concave side facing the top panel.

Optionally, the stress-reducing second fold line is formed from one or more short cuts.

Optionally, the stress-reducing second fold line is disposed between a first one of the at least two curved lines and a second adjacent one of the at least two curved lines.

Optionally, the stress-reducing second fold line is disposed between the first fold line and a notional tangential line that tangentially connects the at least two curved cut lines.

Optionally, the top-engaging carrier further includes a second sloping shoulder panel hinged to the top panel by a third fold line, and the second shoulder panel includes a stress-reducing fourth fold line extending alongside at least a part of the third fold line.

According to a second aspect of the invention, a top-engaging carrier is provided. The top-engaging carrier includes a top panel and a shoulder panel hinged to the top panel by a first fold line. An article-engaging device is provided by at least one of the top panel and the shoulder panel. The carrier further includes a side panel hinged to a lower edge of the shoulder panel and an end panel connected to a side edge of the side panel by a gusset panel. The gusset panel is hinged to the side panel along a side panel fold line and to the end panel along an end panel fold line. The end panel fold line has a length that is less than a length of the side panel fold line.

Optionally, an upper end of the end panel fold line is located below the lower edge of the shoulder panel when the top-engaging carrier is in an erected configuration in which the gusset panel is in a face-contacting arrangement with an inside surface of the side panel.

According to a third aspect of the invention, there is provided a blank for forming a top-engaging carrier. The blank includes a top panel and a shoulder panel hinged to the top panel by a fold line. An article-engaging device is provided by at least one of the top panel and the shoulder panel. The blank further includes a side panel hinged to an outer edge of the shoulder panel and an end panel connected to a side edge of the side panel by a gusset panel. The end panel includes an end portion configured to be secured to an inside surface of the side panel in a set-up carrier. A guide tab is hinged to the end portion along a guide tab fold line and extends generally toward the side panel.

Optionally, the end portion is hinged to the gusset panel by an end panel fold line, and the guide tab is disposed proximate an outer end of the end panel fold line.

Optionally, the guide tab fold line is disposed in alignment with the end panel fold line.

According to a fourth aspect of the invention there is provided a top-engaging carrier including first and second top panels and first and second sloping inner shoulder panels forming a keel structure disposed between said first and second top panels. The keel structure defines a first recess at a first end of the keel structure and a second recess at a second opposite end of the keel structure. A first plurality of article-engaging devices is provided by at least one of the first top panel and the first inner shoulder panel. A second plurality of article-engaging devices is provided by at least one of the second top panel and the second inner shoulder panel. The first inner shoulder panel includes a first fold line disposed at a first end of the first inner shoulder panel and a second fold line disposed at an opposite second end of the first inner shoulder panel. The first fold line is disposed generally between an outermost end of a first outermost one of the first plurality of article-engaging devices and a first outermost edge of the first inner shoulder panel. The second fold line is disposed generally between an outermost end of a second outermost one of the first plurality of article-engaging devices and a second outermost edge of the first inner shoulder panel. The second inner shoulder panel includes a third fold line disposed at a first end of the second inner shoulder panel and a fourth fold line disposed at an opposite second end of the second inner shoulder panel. The third fold line is disposed generally between an outermost end of a first outermost one of the second plurality of article-engaging devices and a first outermost edge of the second inner shoulder panel. The fourth fold line is disposed generally between an outermost end of a second outermost one of the second plurality of article-engaging devices and a second outermost edge of the second inner shoulder panel.

Optionally, the first fold line is generally perpendicular to the first outermost edge of the first inner shoulder panel, the second fold line is generally perpendicular to the second outermost edge of the first inner shoulder panel, the third fold line is generally perpendicular to the first outermost edge of the second inner shoulder panel, and the fourth fold line is generally perpendicular to the second outermost edge of the second inner shoulder panel.

Optionally, the first fold line is generally parallel to the first outermost edge of the first inner shoulder panel, the second fold line is generally parallel to the second outermost edge of the first inner shoulder panel, the third fold line is generally parallel to the first outermost edge of the second inner shoulder panel, and the fourth fold line is generally parallel to the second outermost edge of the second inner shoulder panel.

According to a fifth aspect of the invention, there is provided a top-engaging carrier including a top panel, an outer sloping shoulder panel hinged to the top panel along an outer side of the top panel via a first fold line, and an inner sloping shoulder panel hinged to the top panel along an inner side of the top panel via a second fold line. The first fold line is interrupted by a first plurality of article-engaging devices. The second fold line is interrupted by a second plurality of article-engaging devices. The outer sloping shoulder panel has a width that is greater than a width of the inner sloping shoulder panel.

Optionally, the top panel includes a first top panel, the outer sloping shoulder panel includes a first outer sloping shoulder panel, and the inner sloping shoulder panel includes a first inner sloping shoulder panel. The top-engaging carrier further includes a second top panel, a second outer sloping shoulder panel hinged to the second top panel along an outer side of the second top panel, and a second inner sloping shoulder panel hinged to the second top panel along an inner side of the second top panel. The top-engaging carrier is configured to engage a plurality of articles arranged in a two-row group.

Optionally, the first and second inner sloping shoulder panels are hinged to one another along a central fold line and together form a keel structure.

Within the scope of this application it is envisaged that the various aspects, embodiments, examples, features and alternatives set out in the preceding paragraphs, in the claims and/or in the following description and drawings may be taken independently or in any combination thereof. For example, features described in connection with one embodiment are applicable to all embodiments unless there is incompatibility of features.

BRIEF DESCRIPTION OF THE DRAWINGS

Exemplary embodiments of the invention will now be described with reference to the accompanying drawings, in which.

DETAILED DESCRIPTION

Detailed descriptions of specific embodiments of cartons and blanks are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the cartons and blanks described herein may be embodied in various and alternative forms. The Figures are not necessarily to scale and some features may be exaggerated or minimized to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

In the embodiments detailed herein, the term "carton" or "carrier" refers, for the non-limiting purpose of illustrating the various features of the invention, to a container for transporting, storing, and/or dispensing articles, such as, e.g., aluminum cans. However, it is contemplated that the teachings of the invention can be applied to various containers suitable for carrying a wide variety of articles. For example other flanged articles may be supported; bottles may be supported and the article-engaging devices described may take many forms.

Figure 1:
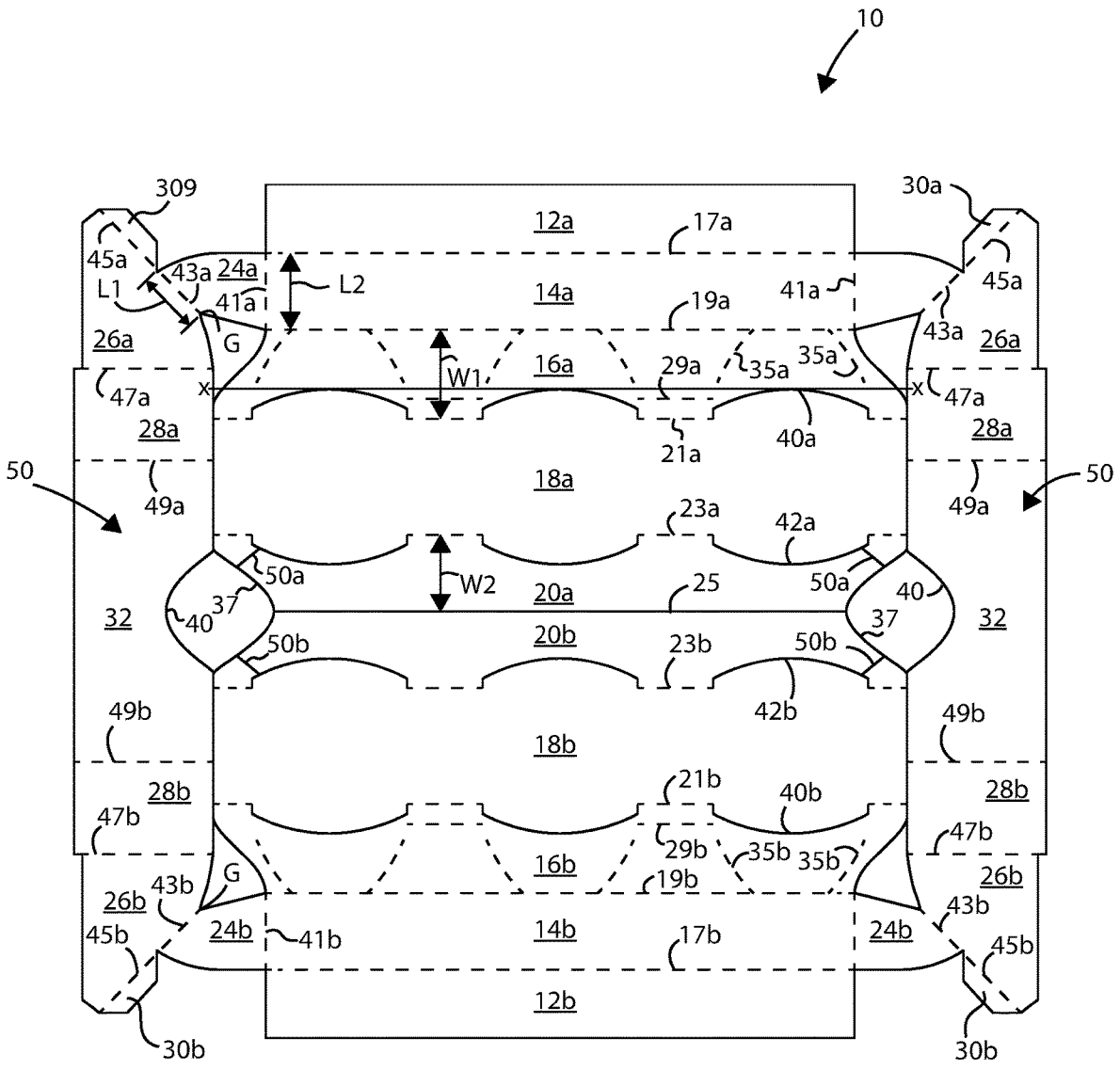
FIG. 1 is a top plan view of an exemplary blank of sheet material according to a first embodiment of the invention.

Referring to FIG. 1, there is shown a first blank 10 for forming a carrier or carton 90 (see FIGS. 3-6). The blank 10 is formed from a sheet of suitable substrate. It is to be understood that, as used herein, the term "suitable substrate" includes all manner of foldable sheet material such as paperboard, corrugated board, cardboard, plastic, combinations thereof, and the like. It should be recognized that one or other numbers of blanks may be employed, for example, to provide the cartons described in more detail below. Additionally, whereas both of the illustrated embodiments in FIGS. 3 to 11 are suitable for securely holding six articles arranged in two rows of three articles each, the invention is not limited in its application to such an arrangement.

Referring still to FIG. 1, blank 10 is generally rectangular in shape and is generally symmetrical about central longitudinal and transverse axes. Blank 10 includes a plurality of panels 12*a*, 14*a*, 16*a*, 18*a*, 20*a*, 20*b*, 18*b*, 16*b*, 14*b*, and 12*b* hinged together in a linear transverse series. The blank 10 includes a first lower side panel 12*a* hinged to a first upper side panel 14*b* via longitudinal fold line 17*a*. First upper side panel 14*b* is hinged to a first outer shoulder panel 16*a* via longitudinal fold line 19*a*. First outer shoulder panel 16*a* is hinged to first top panel 18*a* via longitudinal fold line 21*a*. First top panel 18*a* is hinged to first inner shoulder panel 20*a* via longitudinal fold line 23*a*. First inner shoulder panel 20*a* is hinged to second inner shoulder panel 20*b* via longitudinal fold line 25. Second inner shoulder panel 20*b* is hinged to second top panel 18*b* via longitudinal fold line 23*b*. Second top panel 18*b* is hinged to second outer shoulder panel 16*b* via longitudinal fold line 21*b*. Second outer shoulder panel 16*b* is hinged to second upper side panel 14*b* via longitudinal fold line 19*b*. Second upper side panel 14*b* is hinged to second lower side panel 12*b* via longitudinal fold line 17*b*.

Each of the first and second top panels 18*a*, 18*b* includes opposed pairs of article-engaging devices 40*a*, 42*a* (and 40*b*, 42*b*) formed therein and generally along respective longitudinal fold lines 21*a*, 23*a* (and 21*b*, 23*b*). Longitudinal fold lines 21*a*, 23*a* hingedly interconnect the respective series of article-engaging devices 40*a*, 42*a*. Longitudinal fold lines 21*b*, 23*b* hingedly interconnect the respective series of article-engaging devices 40*b*, 42*b*. In the illustrated first embodiment, each of the article-engaging devices 40*a*, 40*b*, 42*a*, 42*b* takes the form of a curved slit. In other embodiments, each of the article-engaging devices may be formed by a series of curved frangible lines. In other embodiments, the article-engaging devices 40*a*, 40*b*, 42*a*, 42*b* may comprise apertures for receiving upper parts of articles held by the carrier. It will be understood that many mechanisms exist for clipping, locking, or engaging the tops or other portions of articles (such as radially protruding portions or flanges) for holding the articles in an assembled and secure group so that a number of articles may easily be purchased and transported at the same time. In the illustrated first embodiment, the article-engaging devices 40*a*, 40*b*, 42*a*, 42*b* take the form of C-shaped slits which open when the top panels 18*a*, 18*b* are folded about the fold lines 21*a*, 23*a*, 21*b*, 23*b*, each thereby providing an article-engaging edge. Once opened, the slits are sized similarly to or substantially equal to the rim edge of a can C.

Figure 2:
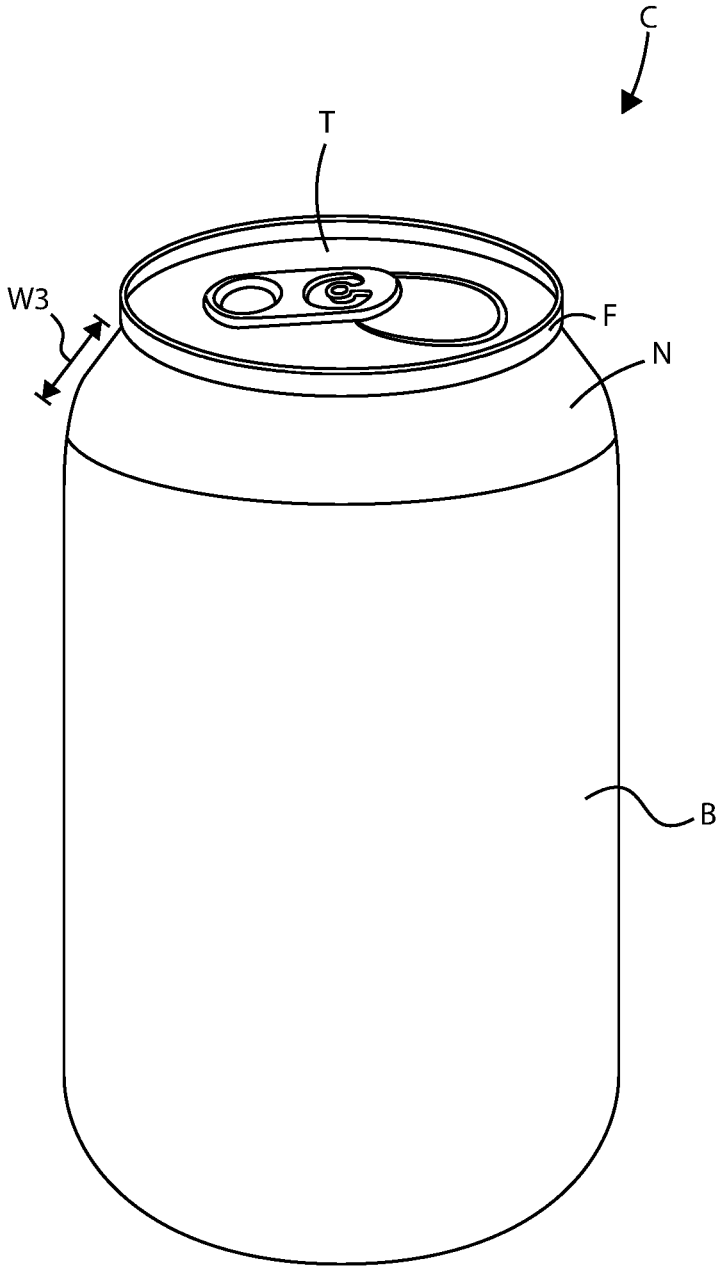
FIG. 2 is a perspective view of an exemplary can of a type that can be carried by the containers of the invention.
Figure 3:
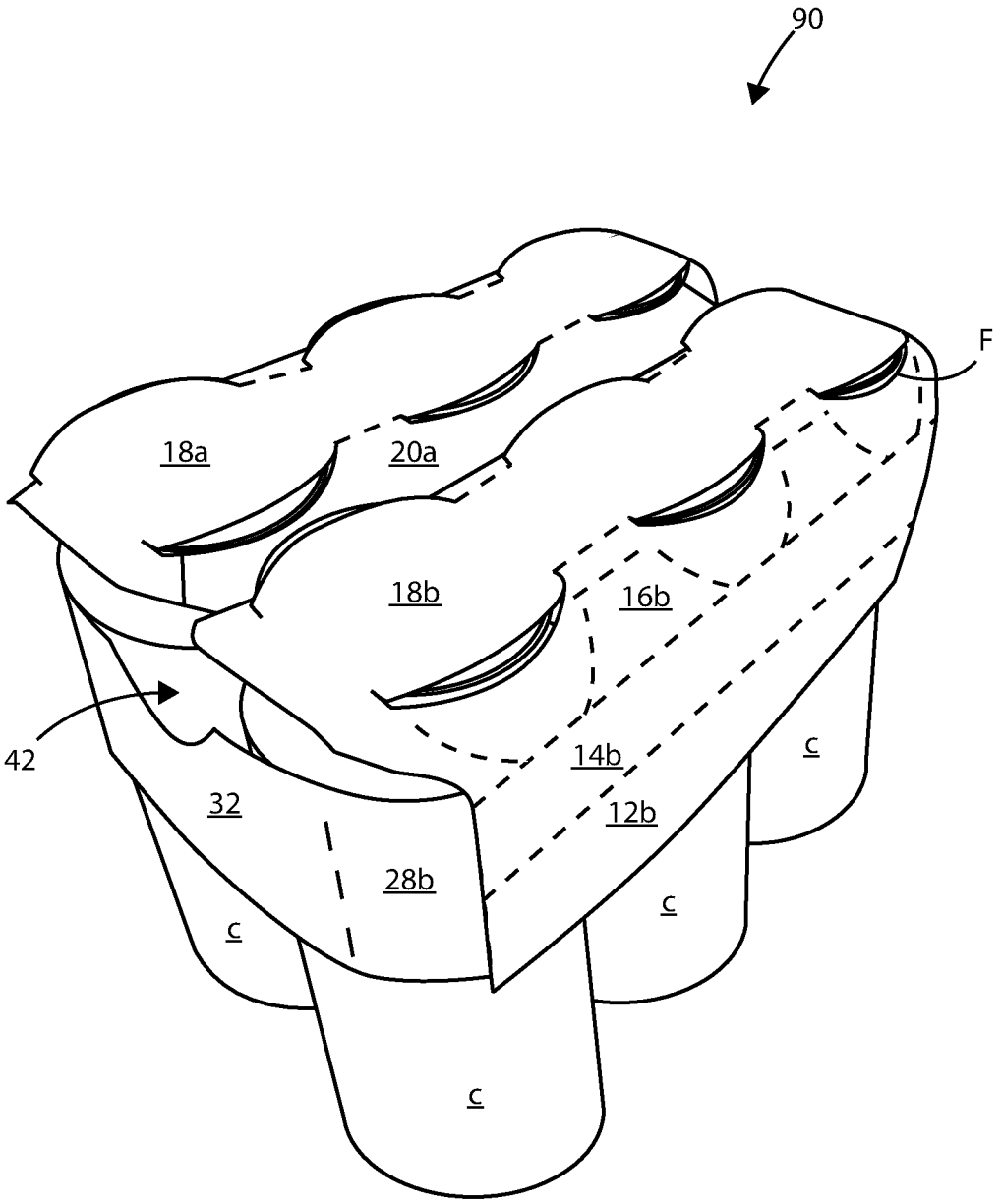
FIG. 3 is a first perspective view of a container formed from the blank shown in FIG. 1.
Figure 4:
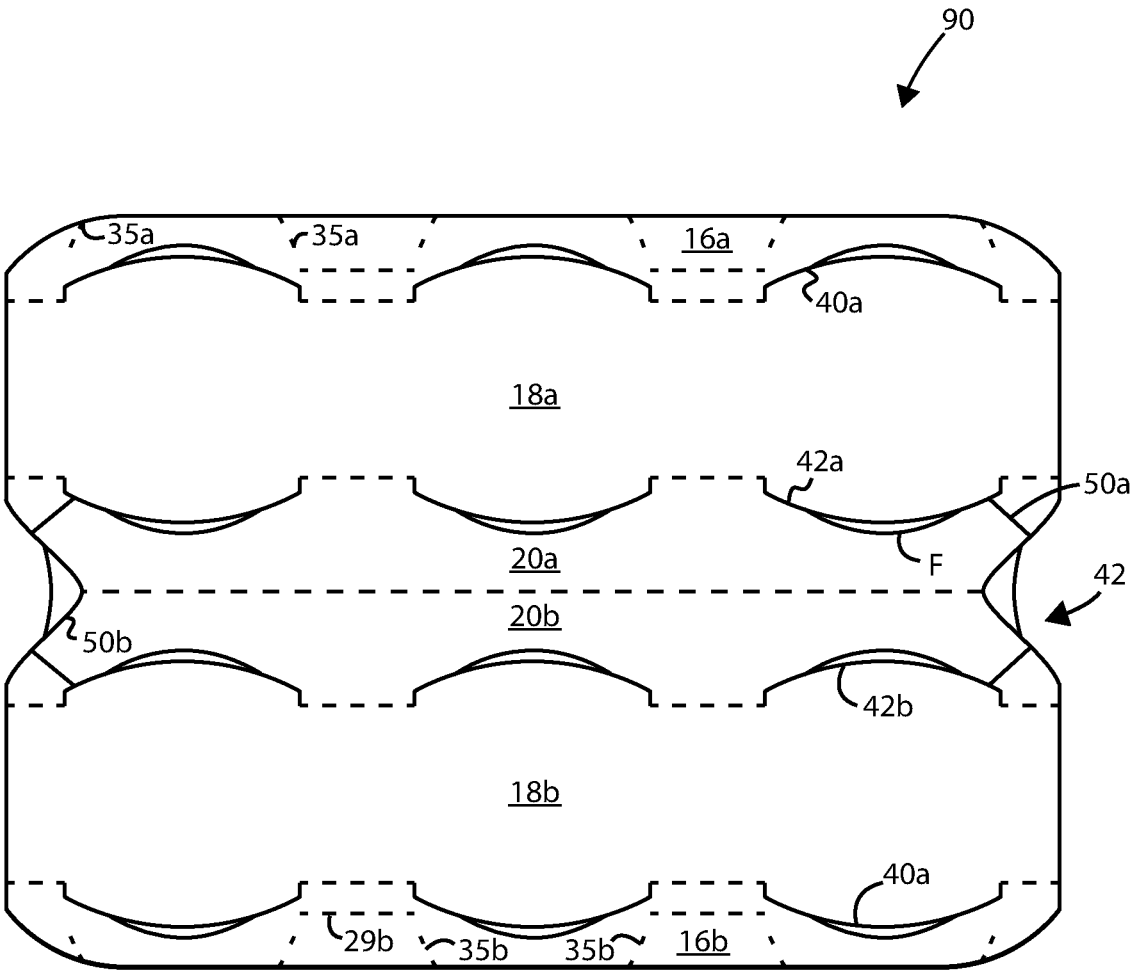
FIG. 4 is a top view of the container of FIG. 3.
Figure 5:
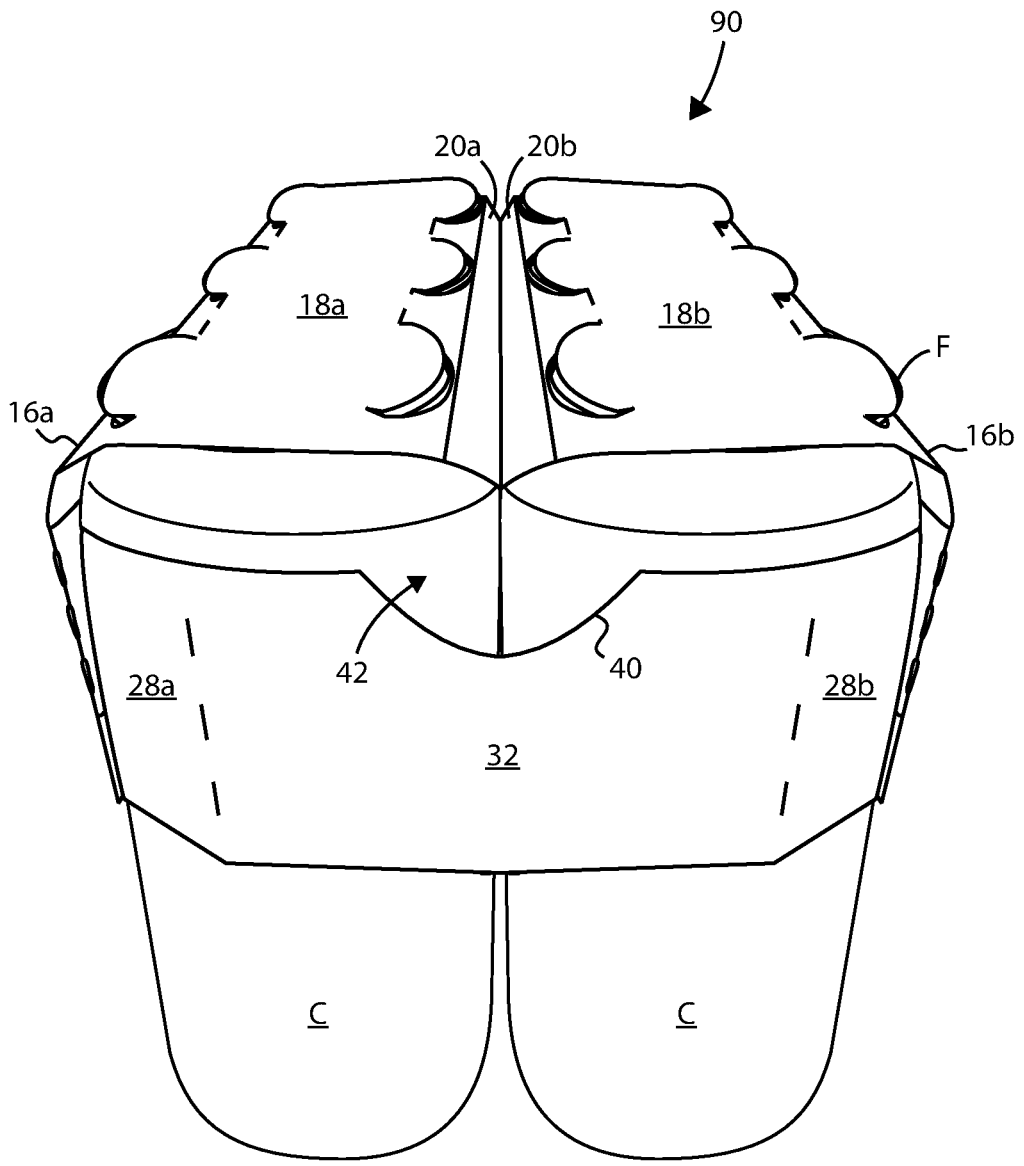
FIG. 5 is an end perspective view of the container of FIG. 3.
Figure 6:
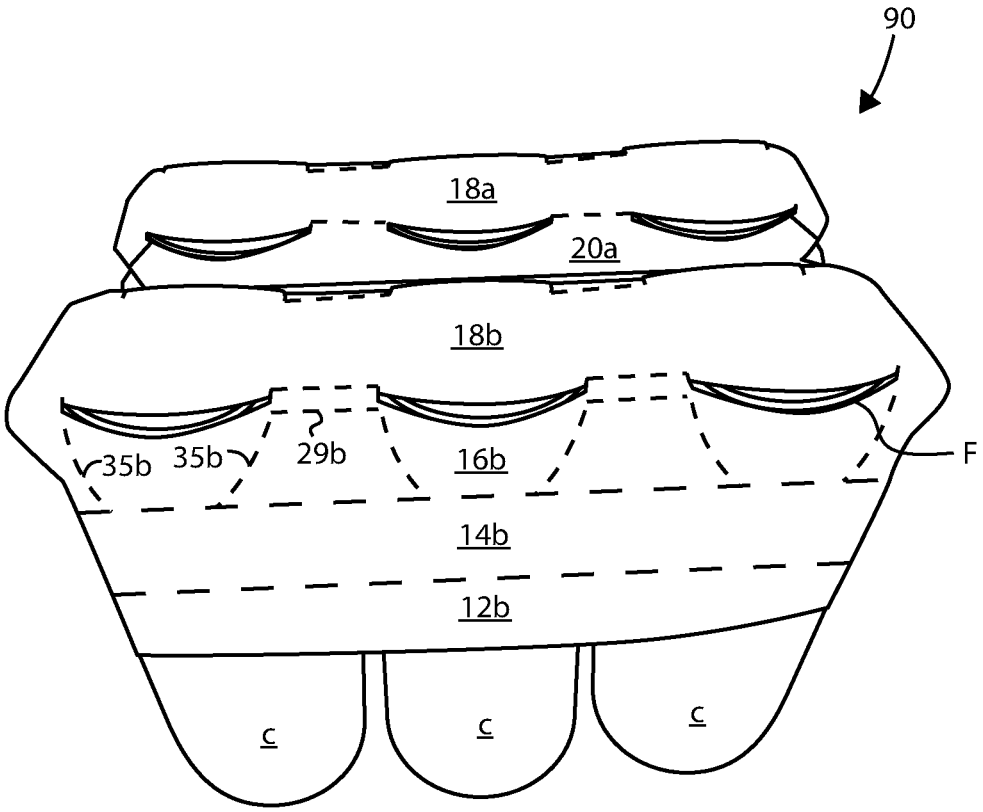
FIG. 6 is a side perspective view of the container of FIG. 3.

Cans, such as the can C shown in FIG. 2, typically have a cylindrical body B and a flattish top T, with a tapered neck portion N of reduced diameter between the top and cylindrical body, and a rim edge or flange portion F at the top of the neck portion that extends radially outward from the neck portion.

Whereas the article-engaging devices 40*a*, 40*b*, 42*a*, 42*b* provide one mechanism for retaining the articles C in a grouped assembly, a further retaining mechanism is provided by the side panels 12*a*, 14*a*, 12*b*, 14*b* and by end flaps 50 and gusset panels 24*a*, 24*b*. End flaps 50 are disposed at opposite ends of blank 10 although end flaps 50 are not directly connected to either the top panels 18*a*, 18*b* or shoulder panels 16*a*, 20*a*, 16*b*, 20*b*. Each of the end flaps 50 includes a center portion 32, first and second corner portions 28*a*, 28*b*, first and second extension portions 26*a*, 26*b*, and first and second guide tabs 30*a*, 30*b*. First and second corner portions 28*a*, 28*b* are hingedly connected to respective ends of center portions 32 via respective longitudinal fold lines 49*a*, 49*b*. First and second extension portions 26*a*, 26*b* are hingedly connected to respective first and second corner portions 28*a*, 28*b* via respective longitudinal fold lines 47*a*, 47*b*. Extension portions 26*a*, 26*b* and fold lines 47*a*, 47*b* facilitate the tight and smooth wrapping of the retention structures about the group of articles which in the illustrated embodiments are cans and have curved surfaces.

Gusset panels 24*a* link first extension portions 26*a* to respective ends of first upper side panel 14*a*. Gusset panels 24*a* are hingedly connected to first extension portions 26*a* via obliquely-extending fold lines 43*a*, and to first upper side panel 14*a* via transverse fold lines 41*a*. Similarly, gusset panels 24*b* link second extension portions 26*b* to respective ends of second upper side panel 14*b*. Gusset panels 24*b* are hingedly connected to second extension portions 26*b* via obliquely-extending fold lines 43*b*, and to second upper side panel 14*b* via transverse fold lines 41*b*. Gusset panels 24*a*, 24*b* facilitate the automatic folding of the side panels 12*a*, 14*a*, 12*b*, 14*b* against the sides of the articles in the adjacent rows upon the folding of extension portions 26*a*, 26*b*. The gusset panels 24*a*, 24*b* become sandwiched between an innermost extension portion 26*a*, 26*b* and an outermost upper side panel 14*a*, 14*b*. The end panel fold lines 43*a*, 43*b* have a length L1 that is less than a length L2 of the side panel fold lines 41*a*, 41*b*. The upper ends of the end panel fold lines 43*a*, 43*b* (labeled Gin FIG. 1) are configured to be located beneath the lower edges of respective first and second outer shoulder panels 16*a*, 16*b* in the constructed carton when the gusset panels 24*a*, 24*b* are in face-contacting arrangement with an inside surface of respective first and second upper side panels 14*a*, 14*b*.

First and second guide tabs 30*a*, 30*b* are hinged to respective first and second extension portions 26*a*, 26*b* via respective obliquely-extending guide tab fold lines 45*a*, 45*b*. First and second guide tabs 30*a*, 30*b* extend generally toward respective first and second lower side panels 12*a*, 12*b*. First and second guide tabs 30*a*, 30*b* are disposed proximate to the outer ends of respective end panel fold lines 43*a*, 43*b*. In the illustrated embodiment, the guide tab fold lines 45*a*, 45*b* are disposed in alignment with respective end panel fold lines 43*a*, 43*b*.

In the illustrated embodiment, first and second outer shoulder panels 16*a*, 16*b* each include one or more second or stress-reducing fold lines 29*a*, 29*b* that extend alongside at least part of respective fold lines 21*a*, 21*b*. Second fold lines 29*a*, 29*b* may serve a stress-reducing function, facilitating the contouring of shoulder panels 16*a*, 16*b* to corresponding portions of the necks N of adjacent articles. Stress-reducing fold lines 29*a*, 29*b* may also facilitate keeping top panels 18*a*, 18*b* in as flat a configuration as possible. In the illustrated first embodiment, stress-reducing fold lines 29*a*, 29*b* are generally straight and are formed by one or more short cuts. Stress-reducing fold lines 29*a*, 29*b* can be disposed between two adjacent ones of cut lines 40*a*, 40*b*. Stress-reducing fold lines 29*a*, 29*b* can be located between the first fold line 21*a*, 21*b* and a notional tangential line (X-X) that tangentially connects at least two of the respective cut lines 40*a*, 40*b*.

First and second outer shoulder panels 16*a*, 16*b* each have a width W1 that is greater than a width W2 of the first and second inner shoulder panels 20*a*, 20*b*. In one or more embodiments, W1 may be about equal to, but slightly greater than, a width W3 of the neck N of the can C. Width W2 may be about equal to, but slightly less than, width W3.

First and second outer shoulder panels 16*a*, 16*b* may also each include pairs of arcuate fold lines 35*a*, 35*b*. Each pair of arcuate fold lines 35*a*, 35*b* is generally aligned with the respective ends of a corresponding cut line 40*a*, 40*b* as shown. Fold lines 35*a*, 35*b* may serve a stress-reducing function by facilitating the contouring of shoulder panels 16*a*, 16*b* to the neck portions of adjacent articles C.

First and second inner shoulder panels 20*a*, 20*b* together define generally U-shaped end notches or recesses 37 at respective ends thereof. Each of the end notches 37 is aligned with a corresponding U-shaped notch or recess 40 that is formed in the respective center portion 32 of the adjacent end panel 50. Notches 37 and 40 together form finger openings 42 that can be used to receive one or more of a user's fingers to facilitate the grasping and carrying of the carton 90. Inner shoulder panels 20*a*, 20*b* include at opposite ends thereof oblique fold lines 50*a*, 50*b* that extend generally between an outermost end of an outermost slit 42*a*, 42*b* and an adjacent outermost edge of the shoulder panel 20*a*, 20*b*. Fold lines 50*a*, 50*b* may be generally perpendicular to the adjacent outermost edge of their respective shoulder panel. Oblique fold lines 50*a*, 50*b* may facilitate the contouring of inner shoulder panels 20*a*, 20*b* to the neck portions of adjacent articles C.

Turning to the construction of the carton 90 as shown in FIGS. 3-6, the article-engaging devices 40*a*, 40*b*, 42*a*, 42*b* can be first utilized to attach the carton blank 10 to the group of articles C. Relative movement between the cans C and blank 10 cause the can rims or flanges F to be forced through the slits 40*a*, 40*b*, 42*a*, 42*b*. The inner and outer shoulder panels 16*a*, 16*b*, 20*a*, 20*b* are folded at an angle relative to the top panels 18*a*, 18*b* and as such the carton closely follows the contour of the grouped articles C and slits 40*a*, 40*b*, 42*a*, 42*b* are allowed to open further. Due to the natural resilience of the carton substrate (e.g., paperboard), the edges of the slits 40*a*, 40*b*, 42*a*, 42*b* snap back to engage a portion of the can of slightly narrower diameter than the rims and in this way the top panels 18*a*, 18*b* are clipped to the articles C. The inner shoulder panels 20*a*, 20*b* together form a keel structure that extends between the two top panels 18*a*, 18*b*.

Assembly of the carton is completed by folding of the composite end flaps 50 against the ends of the article group. This is accomplished via inward folding of the gusset panels 24*a*, 24*b* (together with end flaps 50) about fold lines 41*a*, 41*b*. Extension portions 26*a*, 26*b* are then folded inwardly about respective fold lines 47*a*, 47*b*. This tends to cause outward folding of the gusset panels 24*a*, 24*b* about respective fold lines 43*a*, 43*b* as well as inward folding of the composite side panels (i.e., 12*a*, 14*a* and 12*b*, 14*b*) about respective fold lines 19*a*, 19*b*. Folding of composite side panels is continued about respective fold lines 19*a*, 19*b*, bringing the interior of the composite side panels into contact with the sides of the article group. The exterior surfaces of the extension panels 26*a*, 26*b* can be adhered to the exterior surfaces of respective gusset panels 24*a*, 24*b* and/or to the interior surfaces of respective lower side panels 12*a*, 12*b* via glue or other adhesive so as to form a tight structure wrapped around the article group. The assembly process is not limited to that described above and may be altered according to particular manufacturing requirements.

Figure 7:
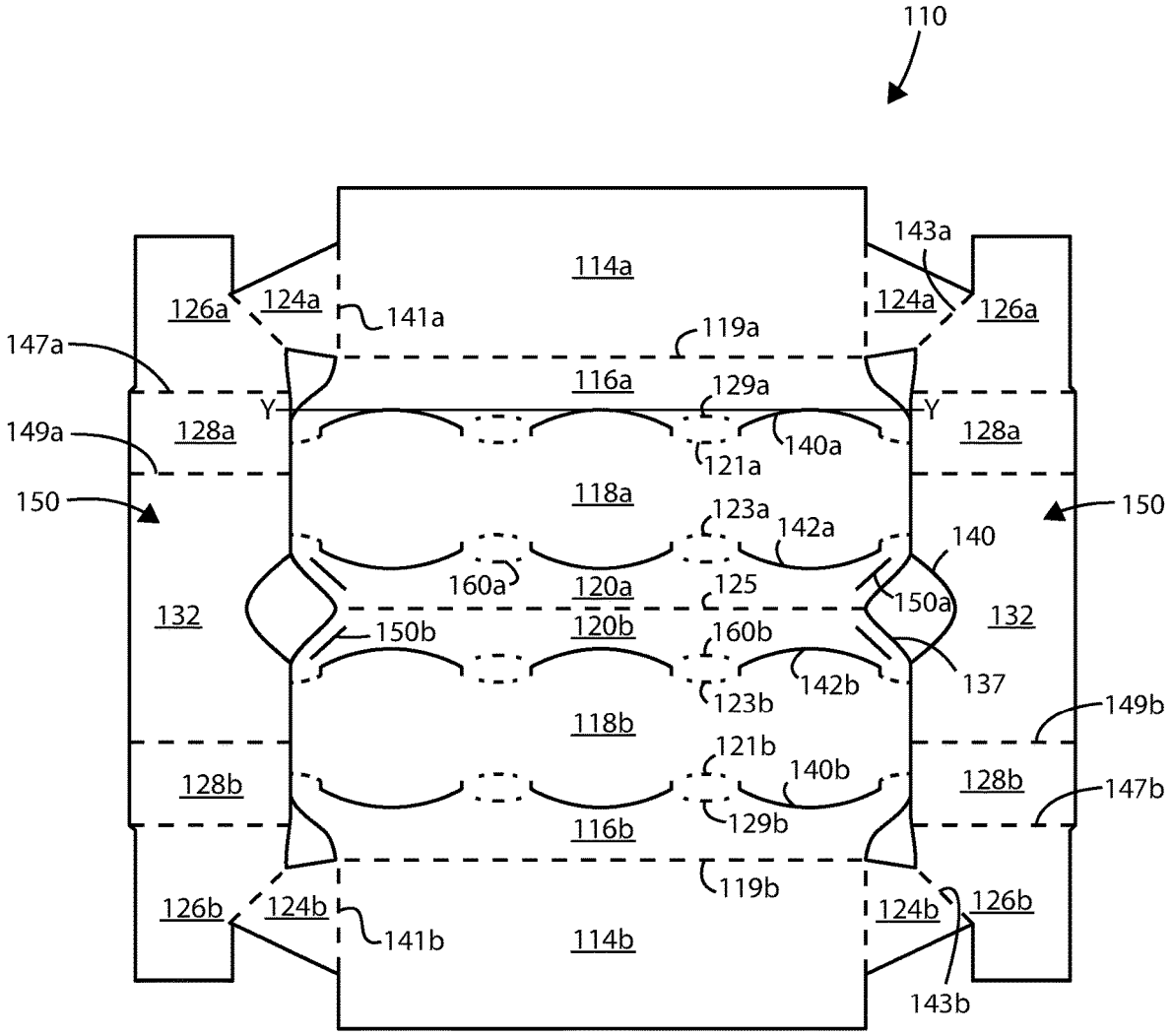
FIG. 7 is a top plan view of an exemplary blank of sheet material according to a second embodiment of the invention.
Figure 8:
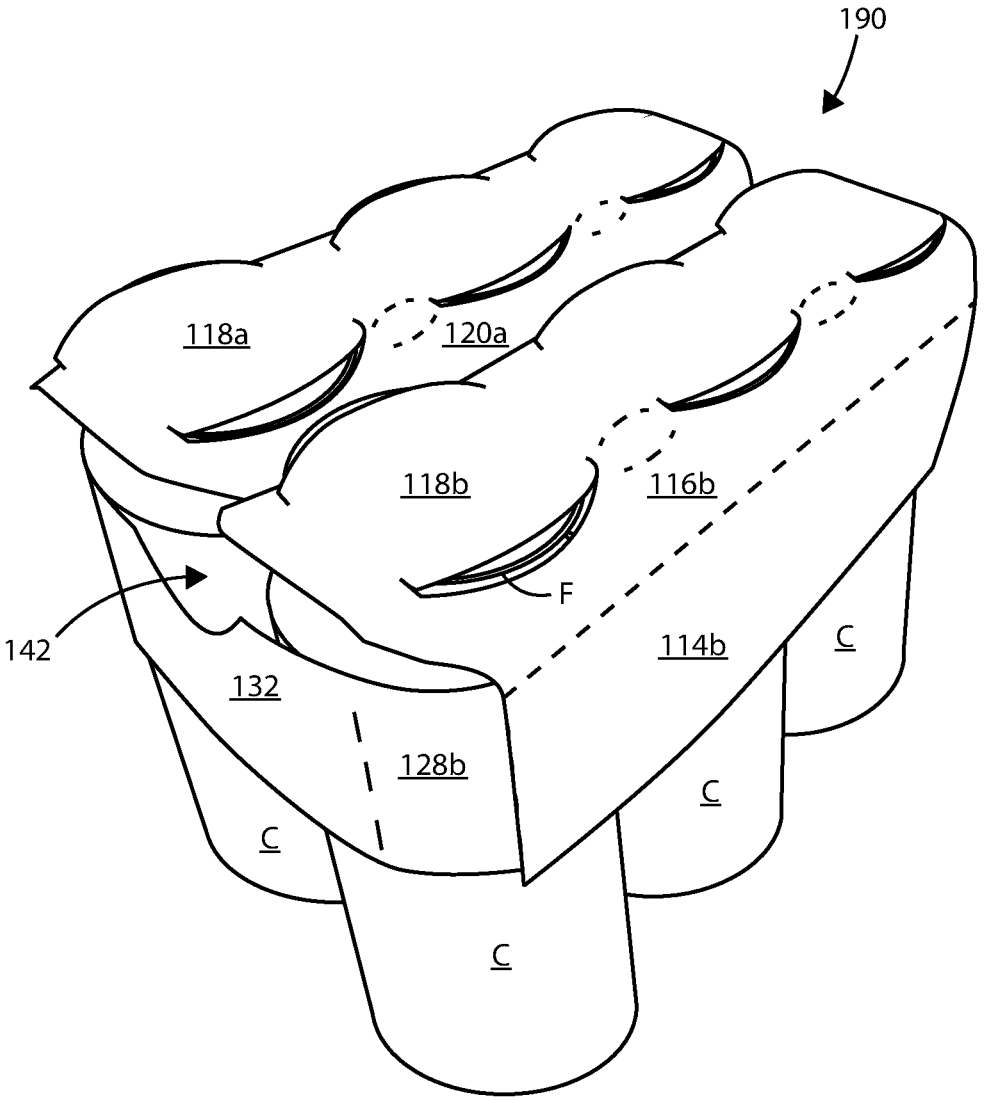
FIG. 8 is a first perspective view of the container formed from the blank shown in FIG. 7.
Figure 9:
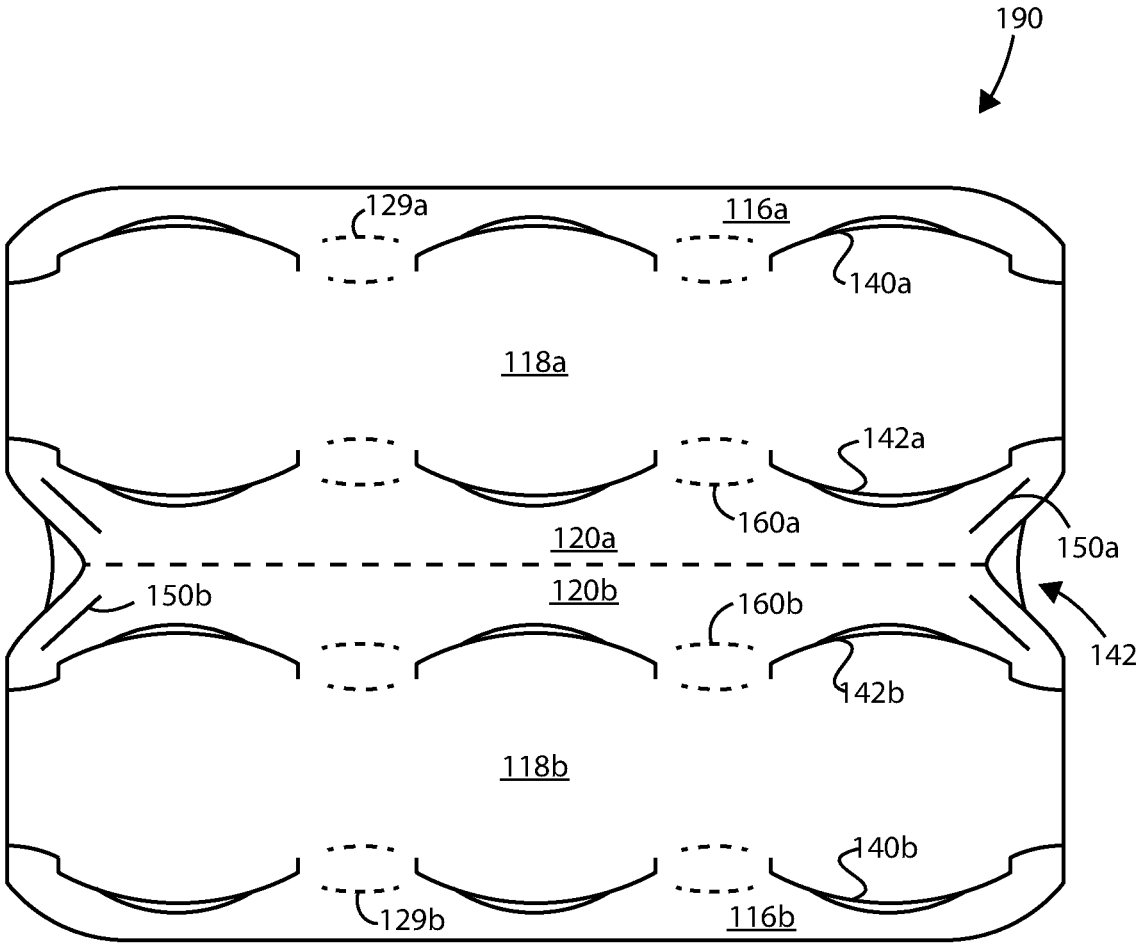
FIG. 9 is a top view of the container of FIG. 8.
Figure 10:
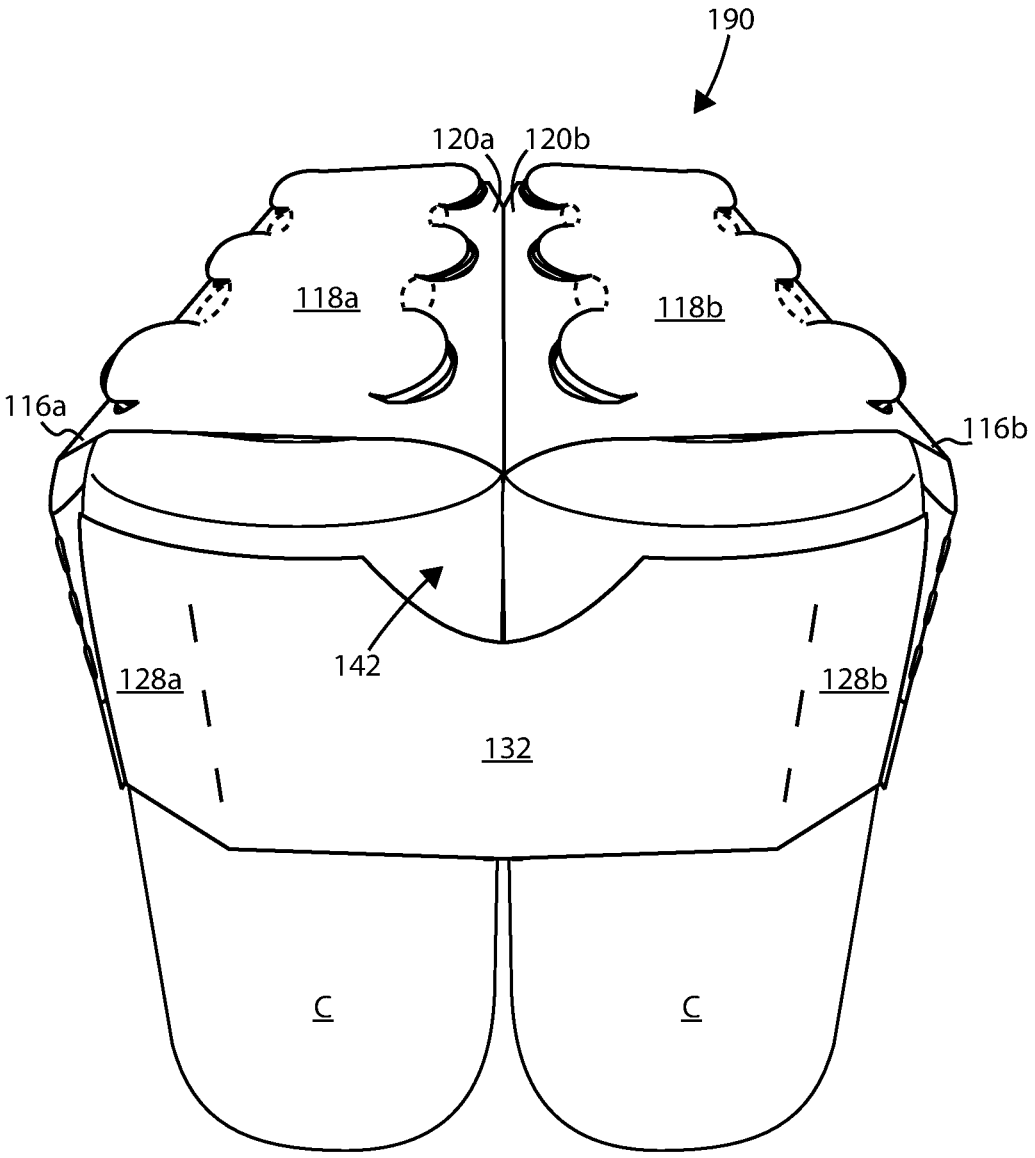
FIG. 10 is an end perspective view of the container of FIG. 8.
Figure 11:
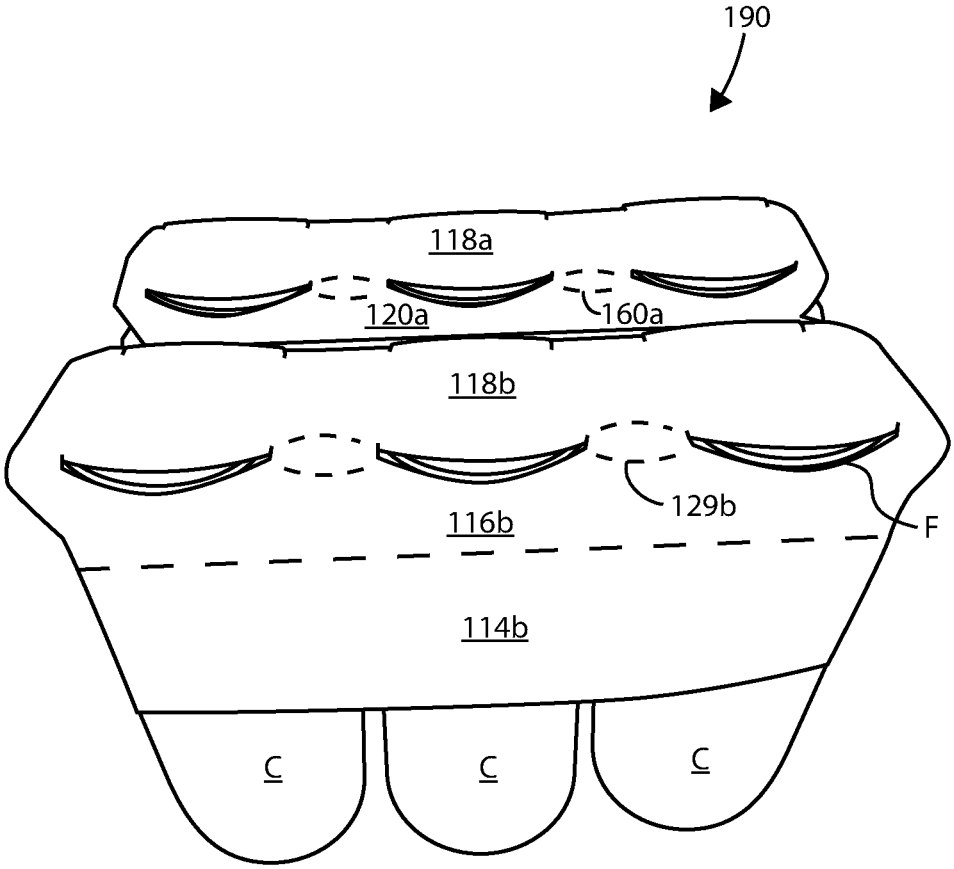
FIG. 11 is a side perspective view of the container of FIG. 8.

FIG. 7 is a plan view of a blank 110 used to form a carton 190 according to a second embodiment of the invention. Blank 110 and the corresponding carton 190 can be generally similar to the blank 10 and carton 90 discussed above, and like or similar reference numbers in the figures indicate like or similar elements.

There are a number of differences between the first and second embodiments. For example, blank 110 includes single side panels 114*a*, 114*b* on each side rather than upper and lower side panels hinged together along a fold line as was the case with the first embodiment. In addition, in the second embodiment, blank 110 does not include guide tabs hingedly connected to the first and second extension portions 126*a*, 126*b* of end flaps 150.

In the second embodiment, the fold lines 121*a*, 123*a* (and 121*b*, 123*b*) that hingedly interconnect the series of article-engaging devices 140*a*, 142*a* (and 140*b*, 142*b*) are slightly arcuate in shape, rather than straight, with their convex sides disposed toward the interiors of respective adjacent top panels 118*a*, 118*b*.

First and second outer shoulder panels 114*a*, 114*b* each include one or more second or stress-reducing fold lines 129*a*, 129*b* that extend alongside at least part of respective fold lines 121*a*, 121*b*. In the illustrated second embodiment, stress-reducing fold lines 129*a*, 129*b* are generally arcuate (rather than straight as in the first embodiment) with their concave sides disposed toward the interiors of respective adjacent top panels 118*a*, 118*b*. As in the first embodiment, stress-reducing fold lines 129*a*, 129*b* can be disposed between two adjacent ones of cut lines 140*a*, 140*b*. Stress-reducing fold lines 129*a*, 129*b* can be located between the respective first fold line 121*a*, 121*b* and a notional tangential line (Y-Y) that tangentially connects at least two of the respective cut lines 140*a*, 140*b*.

In the illustrated second embodiment, first and second inner shoulder panels 120*a*, 120*b* also include one or more second or stress-reducing fold lines 160*a*, 160*b* that extend alongside at least part of respective fold lines 123*a*, 123*b*. Stress-reducing fold lines 160*a*, 160*b* may generally mirror the stress-reducing fold lines 129*a*, 129*b* disposed on the first and second outer shoulder panels 116*a*, 116*b*. Stress-reducing fold lines 160*a*, 160*b* may facilitate the contouring of inner shoulder panels 120*a*, 120*b* to corresponding portions of the necks N of adjacent articles.

Inner shoulder panels 120*a*, 120*b* include at opposite ends thereof oblique fold lines 150*a*, 150*b* that are generally disposed between an outermost end of an outermost slit 142*a*, 142*b* and an adjacent outermost edge of the shoulder panel 120*a*, 120*b*. Unlike the oblique fold lines 50*a*, 50*b* in the first embodiment, oblique fold lines 150*a*, 150*b* extend generally parallel to the adjacent outermost edges of their respective shoulder panels as shown. Oblique fold lines 150*a*, 150*b* may facilitate the contouring of inner shoulder panels 120*a*, 120*b* to the neck portions of adjacent articles C.

The construction of carton 190 may be generally similar to the construction of carton 90 described above.

Exemplary embodiments of blanks and methods for forming containers are described above in detail. The apparatus and methods are not limited to the specific embodiments described herein, but rather, components of apparatus and/or steps of the methods may be utilized independently and separately from other components and/or steps described herein. For example, the methods may also be used in combination with other containers and methods, and are not limited to practice with only the containers and methods as described herein. Rather, the exemplary embodiment can be implemented and utilized in connection with many other container applications.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A top-engaging carrier comprising:

a top panel, and a sloping shoulder panel hinged to the top panel by a first fold line, wherein the first fold line is interrupted by at least two curved cut lines such that by folding the shoulder panel about the first fold line, an article-engaging edge is defined by each of the at least two curved cut lines; and wherein the shoulder panel comprises a stress-reducing second fold line extending alongside at least a part of the first fold line.

2. The top-engaging carrier of claim 1, wherein said stress-reducing second fold line is configured to facilitate the contouring of said shoulder panel to corresponding portions of a plurality of adjacent articles being engaged by the carrier.

3. The top-engaging carrier of claim 1, wherein said article-engaging edge is configured to engage a flange of a can.

4. The top-engaging carrier of claim 1, wherein said stress-reducing second fold line is curved with its concave side facing the top panel.

5. The top-engaging carrier of claim 1, wherein said stress-reducing second fold line is formed from one or more short cuts.

6. The top-engaging carrier of claim 1, wherein said stress-reducing second fold line is disposed between a first one of the at least two curved lines and a second adjacent one of the at least two curved lines.

7. The top-engaging carrier of claim 1, wherein said stress-reducing second fold line is disposed between the first fold line and a notional tangential line that tangentially connects the at least two curved cut lines.

8. The top-engaging carrier of claim 1, wherein said top-engaging carrier further comprises a second sloping shoulder panel hinged to the top panel by a third fold line, and wherein the second shoulder panel comprises a stress-reducing fourth fold line extending alongside at least a part of the third fold line.

9. A top-engaging carrier comprising:

a top panel;

a shoulder panel or a side panel hinged to the top panel by a first fold line;

wherein an article-engaging device is provided by the top panel;

wherein the carrier further comprises an end panel hinged to the top panel and connected to an edge of the side panel by a linking panel, wherein the linking panel is hinged to the side panel along a side panel fold line at one end of the linking panel and to the end panel along an end panel fold line at an opposite end of the linking panel that is opposite the one end, so as to connect the side panel to the end panel, and wherein the end panel fold line has a length that is less than a length of the side panel fold line.

10. The top-engaging carrier of claim 9 wherein an upper end of the end panel fold line is located below the lower edge of the shoulder panel when the top-engaging carrier is in an erected configuration in which the linking panel is in a face-contacting arrangement with an inside surface of the side panel.

11. A blank for forming a top-engaging carrier, the blank comprising:

a top panel;

a shoulder panel hinged to the top panel by a fold line;

wherein an article-engaging device is provided by at least one of the top panel and the shoulder panel;

wherein the blank further comprises a side panel hinged to an outer edge of the shoulder panel and an end panel connected to an edge of the side panel by a gusset panel that is is hinged to the side panel along a side panel fold line at one end of the gusset panel and to the end panel along an end panel fold line at an opposite end of the gusset panel that is opposite the one end, so as to connect the side panel to the end panel;

wherein the end panel comprises an end portion configured to be secured to an inside surface of the side panel in a set-up carrier;

wherein a guide tab is hinged to the end portion along a guide tab fold line and extends generally toward the side panel;

wherein the end portion is hinged to the gusset panel by an end panel fold line.

12. The blank of claim 11, wherein the guide tab is disposed proximate an outer end of the end panel fold line.

13. The blank of claim 12, wherein the guide tab fold line is disposed in alignment with the end panel fold line.

14. A top-engaging carrier comprising:

first and second top panels;

a first inner shoulder panel and a second inner shoulder panel, each of the first inner shoulder panel and the second inner should panel sloping to form a keel structure disposed between said first and second top panels, said keel structure defining a first recess at a first end of said keel structure and a second recess at a second opposite end of said keel structure, each of the first recess and second recess formed by respective free edges of the first inner shoulder panel and the second inner shoulder panel the free edges formed by respective cutlines that are oblique with respect to a center fold line formed between the first inner should panel and the second inner should panel;

wherein a first plurality of article-engaging devices is provided by at least one of the first top panel and the first inner shoulder panel;

wherein a second plurality of article-engaging devices is provided by at least one of the second top panel and the second inner shoulder panel;

wherein the first inner shoulder panel comprises a first fold line disposed at a first end of said first inner shoulder panel and a second fold line disposed at an opposite second end of said first inner shoulder panel, said first fold line being disposed generally between an outermost end of a first outermost one of said first plurality of article-engaging devices and a first outermost edge of said first inner shoulder panel, said second fold line being disposed generally between an outermost end of a second outermost one of said first plurality of article-engaging devices and a second outermost edge of said first inner shoulder panel;

wherein the second inner shoulder panel comprises a third fold line disposed at a first end of said second inner shoulder panel and a fourth fold line disposed at an opposite second end of said second inner shoulder panel, said third fold line being disposed generally between an outermost end of a first outermost one of said second plurality of article-engaging devices and a first outermost edge of said second inner shoulder panel, said fourth fold line being disposed generally between an outermost end of a second outermost one of said second plurality of article-engaging devices and a second outermost edge of said second inner shoulder panel.

15. The top-engaging carrier of claim 14, wherein the first fold line is generally perpendicular to the first outermost edge of the first inner shoulder panel, the second fold line is generally perpendicular to the second outermost edge of the first inner shoulder panel, the third fold line is generally perpendicular to the first outermost edge of the second inner shoulder panel, and the fourth fold line is generally perpendicular to the second outermost edge of the second inner shoulder panel.

16. The top-engaging carrier of claim 14, wherein the first fold line is generally parallel to the first outermost edge of the first inner shoulder panel, the second fold line is generally parallel to the second outermost edge of the first inner shoulder panel, the third fold line is generally parallel to the first outermost edge of the second inner shoulder panel, and the fourth fold line is generally parallel to the second outermost edge of the second inner shoulder panel.

17. A top-engaging carrier comprising:

a top panel;

an outer sloping shoulder panel hinged to the top panel along an outer side of the top panel via a first fold line, wherein the first fold line is interrupted by a first plurality of article-engaging devices; and an inner sloping shoulder panel hinged to the top panel along an inner side of the top panel via a second fold line, wherein the second fold line is interrupted by a second plurality of article-engaging devices;

wherein the outer sloping shoulder panel has a width that is greater than a width of the inner sloping shoulder panel.

18. The top-engaging carrier of claim 17, wherein the top panel comprises a first top panel, the outer sloping shoulder panel comprises a first outer sloping shoulder panel, and the inner sloping shoulder panel comprises a first inner sloping shoulder panel; and wherein the top-engaging carrier further comprises a second top panel, a second outer sloping shoulder panel hinged to the second top panel along an outer side of the second top panel, and a second inner sloping shoulder panel hinged to the second top panel along an inner side of the second top panel, and wherein the top-engaging carrier is configured to engage a plurality of articles arranged in a two-row group.

19. The top-engaging carrier of claim 18, wherein the first and second inner sloping shoulder panels are hinged to one another along a central fold line and together form a keel structure.

* * * * *